United States Patent [19]

Wertz

[11] 4,106,426

[45] Aug. 15, 1978

[54] BOAT AND STEERING APPARATUS THEREFOR

[76] Inventor: Daniel Elanzo Wertz, 250 S. Ocean Blvd., Apt. 11D, Boca Raton, Fla. 33432

[21] Appl. No.: 732,510

[22] Filed: Oct. 14, 1976

[51] Int. Cl.[2] ..... A63H 5/08

[52] U.S. Cl. ..... 115/70; 114/144 R

[58] Field of Search ..... 114/144 R, 146, 140, 114/142, 129; 115/18 R, 70, 35, 6.1; 74/501 R, 501 P, 487, 480 B; 188/2 D

[56] References Cited

U.S. PATENT DOCUMENTS

| | | | |
|---|---|---|---|
| 450,350 | 4/1891 | Bruce | 114/142 |
| 609,570 | 8/1898 | Bowden | 188/2 D |
| 3,552,349 | 1/1971 | Snow | 115/70 |
| 3,799,102 | 3/1974 | Smith | 115/18 R |
| 3,826,220 | 7/1974 | Jacobson | 115/70 |
| 3,870,007 | 3/1975 | Morse | 114/144 R |
| 3,989,002 | 11/1976 | Peterson | 115/70 |

*Primary Examiner*—Galen L. Barefoot
*Attorney, Agent, or Firm*—Malin & Haley

[57] ABSTRACT

The steering cables of a boat pass through tubing that is looped sufficiently so that friction of the cable against the tubing wall will hold an outboard motor in position unless the steering wheel is deliberately turned. The boat has a pair of lengthwise projections from its bottom having flat, vertical sides facing inwardly and sloping sides facing outwardly.

4 Claims, 4 Drawing Figures

BOAT AND STEERING APPARATUS THEREFOR

BACKGROUND OF THE INVENTION

In the manufacture of small boats such as outboard motor boats, of the type where the helmsman faces forward to steer with a steering wheel whose rotation must then be reliably transmitted to the pivotally mounted motor, available transmissions now constitute a significant fraction of the entire cost of the boat. This present high cost results from the fact that it is desirable to hold the motor in position without maintaining a constant force to the steering wheel, and to prevent the ports, which necessary for passing the transmission cables to the steering wheel and to the motor, from leaking water into the hull. Known apparatus for this purpose employ worm gears and rack and pinion devices. But these have not only introduced high costs; they may also become sources of malfunction in the corrosive atmospheres that are associated with boating. Motor propelled boats are known that are capable of being ridden by a single operator in a standing position in the form of a self propelled water ski. However, a man cannot stand or sit on such a boat when it is not in motion, and there has been an unrequited need for an inexpensive shallow draft two-man boat, operable with an outboard motor at high speed, upon which one or two persons could stand, without danger of capsizing, before the boat was underway. Such a boat would require some keel effect to avoid excessive skidding on turns but the keel should not act as a fulcrum for tipping the boat over when the turns are sharp.

SUMMARY

I have invented apparatus for directing a boat that includes a pivotable outboard motor and steering-wheel means comprising two lengths of flexible cable connecting the steering-wheel means to the outboard motor and two lengths of tubing, each enclosing and guiding a substantial portion of one of the lengths of cable. An essential feature of my invention comprises straight lengthwise portions and loops in the tubing which turn outwardly from the straight portions. The loops exponentially increase the frictional resistance against pulling of the cables and, hence, against undesired turning of the outboard motor. These loops subtend angles no less than 225°. Preferable the guide tubing is of metal, such as aluminum, and the cable is formed of strands of nonmetallic material. My boat, which has a substantially smooth bottom, comprised first and second lengthwise projections protruding downwardly from the bottom. The projections are spaced equidistantly from the bottom centerline and preferably extend from the stern at least $\frac{1}{3}$ the length of the boat. Preferable, also, the projections are spaced apart a distance greater than $\frac{1}{3}$ and less than $\frac{2}{3}$ of the width of the bottom. One of the lengthwise edges of each of the projections comprises an essentially vertical flat wall facing inwardly so that the flat walls face each other. The other edge of each of the projections comprises a sloping wall, preferably curvilinear, facing outwardly. In one embodiment my boat is of very shallow draft but is capable of supporting at least two persons and of maintaining stability at rest with a man standing aboard. This boat comprises an elongated watertight buoyant member having a preselected vertical thickness and comprising deck and bottom surfaces, with the bottom surface sloping upwardly at the bow. The buoyant member also comprises a recess in the stern for mounting an outboard motor. A steering pedestal, which is preferably hingedly mounted so that it can be laid against the deck surface for storage or shipment, extends upwardly from a forward portion of the deck surface and has a steering wheel mounted upon it. My boat comprises fuel storage means within the steering pedestal and conduit means embedded in the buoyant member beneath the deck surface for passing fuel to the outboard motor. Tubular means are also embedded beneath the deck surface for guiding cables from the steering pedestal to the outboard motor. These cables connect the outboard motor to the steering wheel. My boat also comprises thickened portions of the buoyant member on both sides of the stern recess. These portions extend substantially, preferably at least $\frac{2}{3}$ the adjacent thickness of the buoyant member, upwardly of the deck surface.

DETAILED DESCRIPTION OF PREFERRED EMBODIMENT

Figure 3:
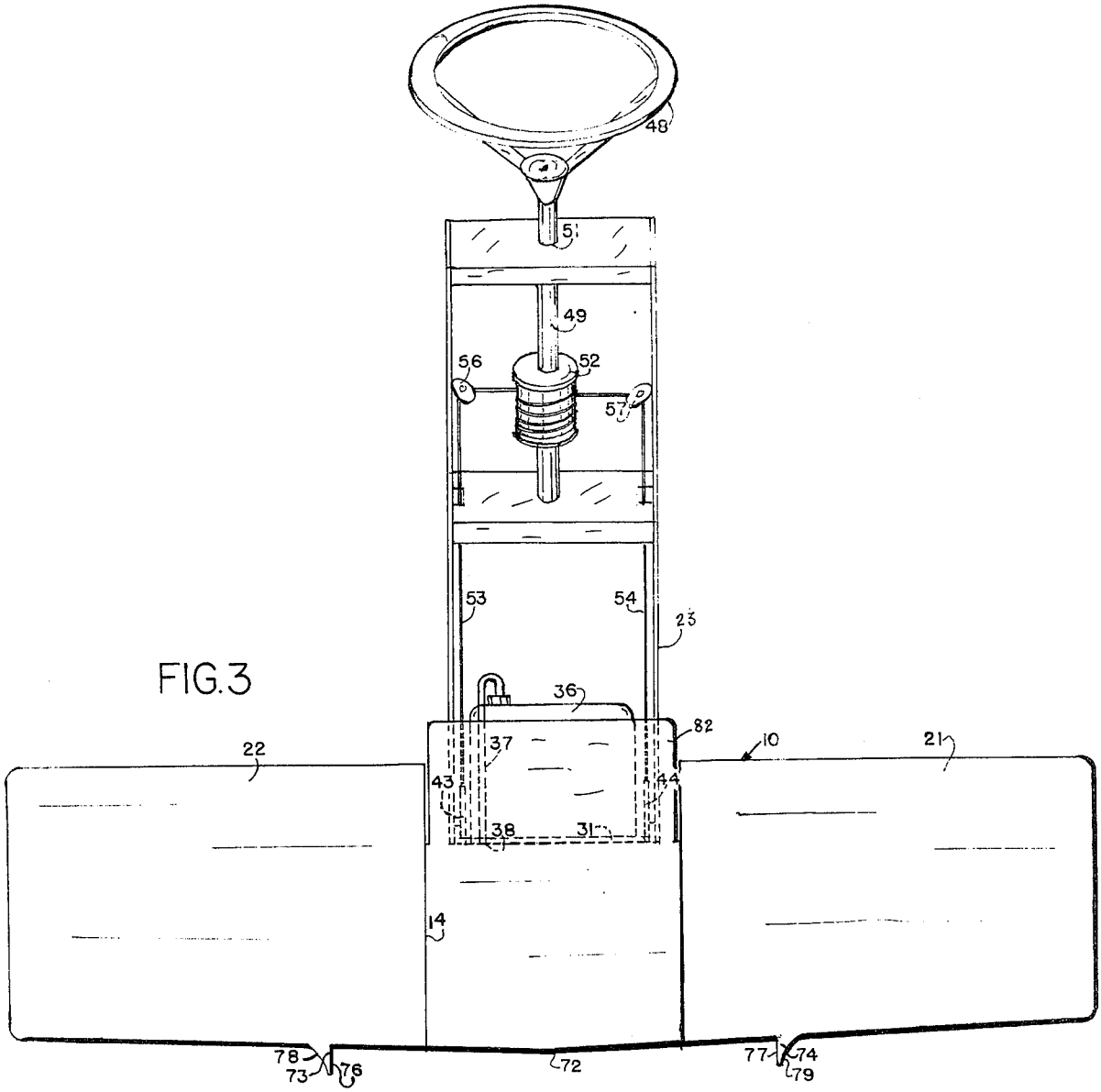
FIG. 3 shows an enlarged stern view of the boat of FIG. 1 with the outboard motor removed.
Figure 4:
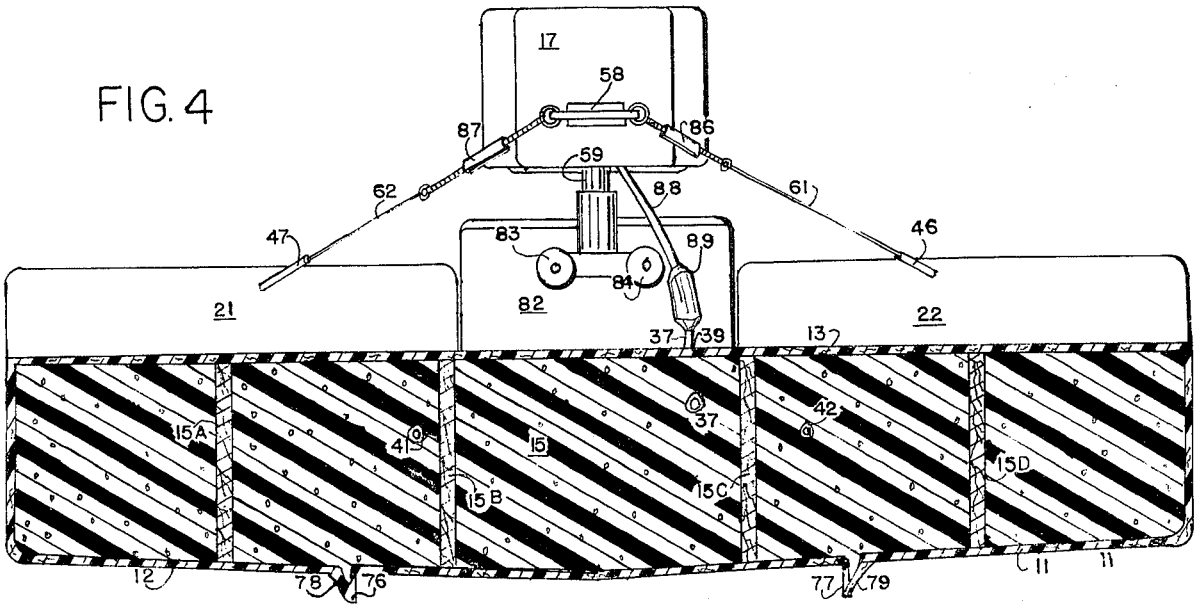
FIG. 4 shows a section through the line 4—4 of FIG. 1.

A boat, indicated generally by the numeral 10 has, as its principal buoyant element, a slab-like member 11 consisting of a glass reinforced polymeric shell filled with buoyant plastic foam 15 and four wooden stiffening beams 15A, 15B, 15C, and 15D (FIG. 4). The shell is watertight and its lower expanse forms a bottom 12 of the boat while its upper expanse contitutes a deck 13 of the boat 10. A recess 14 in the stern of the member 11 provides a safety feature whereby a propeller 16 of a conventional outboard motor 17 will not project too far astern. Except for an upward slope 18 of the bottom 12 at its bow the member 11 has a substantially uniform thickness back to a section 10 where two rectangular portions 21,22 of the member 11 have additional thickness, forming box-like diases on either side of the recess 14 but extending somewhat forward of the recess. It will be understood that water can wash freely over the deck 13 so that flotation of the boat 10 is due entirely to the buoyancy of the material of the water-tight slab-like member 11, the thickened portions 21,22 of which prevent the boat from capsizing when a person steps aboard at a mooring. A steering pedestal 23, to which may be secured seating means, not shown, is bolted to lugs 24–29 of a plate 31 secured to the member 11. By removing bolts 32,33 and matching starboard bolts (not shown) the pedestal can be pivoted on pins 34,35 through the lugs 28,29 to lie flat upon the deck 13 for storage or shipment. A gasoline tank 36 fitted in the pedestal 23 feeds gasoline into a pipe 37 embedded in the member 11 beneath the deck 13. The pipe pierces the deck 13 in a watertight seal at a point 38 near the tank 36 and emerges near the stern through a watertight seal 39 adjacent to the motor 17. Also embedded in the foam plastic of the member 11 are two lengths of aluminum tubing 41,42, stubs 43,44 of which emerge above the deck 13 within the pedestal 23 (FIG. 3), and stubs 46,47 of which (FIG. 4) emerge near the motor 17. A steering wheel 48 having a shaft 49 passing through a bearing 51 is mounted on the pedestal 23. A flanged cylinder 52 is mounted on the shaft 49 to which are secured flexible cables 53,54 of commercially available construction. The cable 53 passes around a pulley 56 into the stub 43 of the tubing 41, and the cable 54 passes around a pulley 57 into the stub 44 of the tubing 42. These cables pass through the embedded lengths of tubing and are connected to an arm 58 of the motor 17 whereby they can cause the motor 17 to turn on its pivot 59. To reach the arm 58 an end 61 of the cable length 53 passes out of the stub 46 and an end 62 of the cable length 54 passes out of the stub 47. It is essential that the lengths of tubing 41,42 be formed into loops 63,64 and for this reason the tubing is not run lengthwise along the outer edges of the member 11 but is run up the center about half the length of the boat in straight portions 66,67 from which portions the lengths are flared outwardly to form the loops 63,64 which must curve through a sufficient angle to afford the desired frictional resistance against free reciprocal movement of the motor 17. When being pulled around the loops 63,64 the frictional restraining force is an exponential function of the angle subtended by the curved portions of the tubing, the low pull that is required to turn the steering wheel of itself being multiplied by this function to act as a restraining effect against undesired turning of the outboard motor. The loops in the illustrated embodiment are not planar but spiral upwardly so that the stubs 46 and 47 emerge from the forward walls of the rectangular portions 21,22 at an upward angle.

Figure 1:
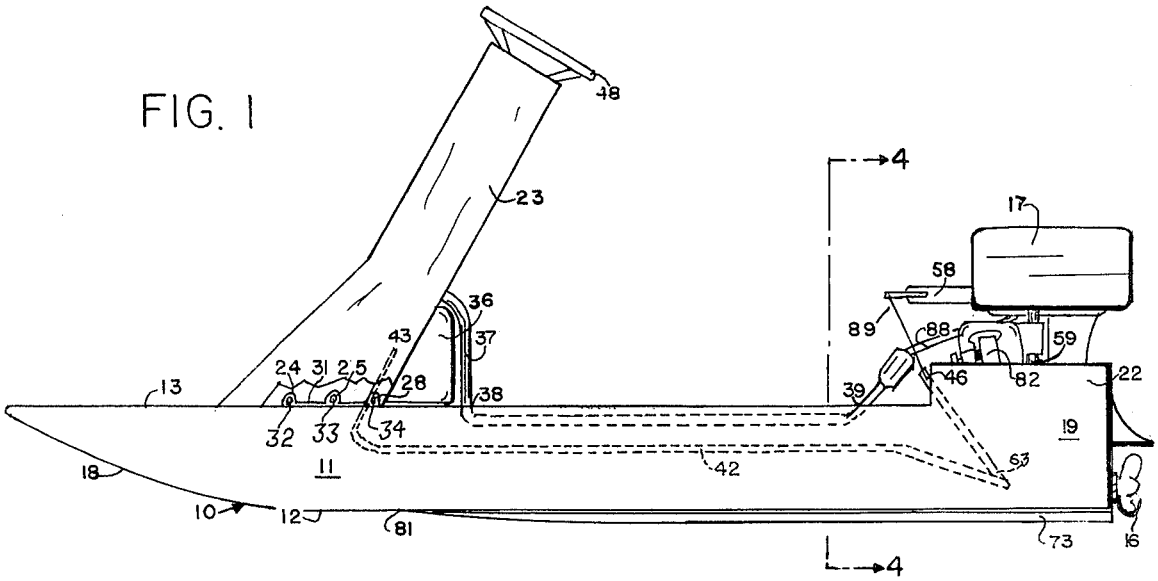
FIG. 1 shows a side view of a boat of my invention.
Figure 2:
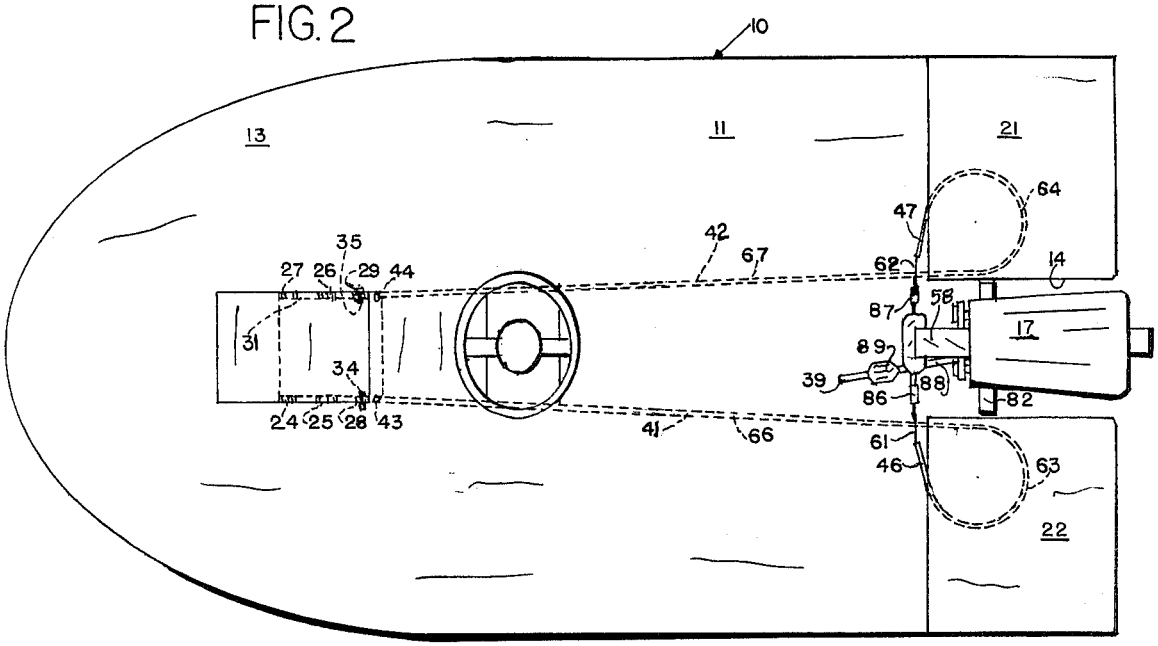
FIG. 2 shows a plan view of the boat of FIG. 1.

A wide range of synthetic and natural organic materials are useful for the cables 53,54 such as hemp, cotton, polyster, nylon, polyethylene, polyvinyl and polypropylene and these may have metal cores, preferably braided so as to provide the necessary flexibility. The bottom 12 of my boat, which corresponds to the bottom of the member 11 has a very shallow V-shape with two smooth surfaces forming a dihedral angle along a certerline 72. The smooth bottom surface is broken by two downward projections 73,74 running fore and aft lengthwise of the boat and spaced equally from the centerline 72. An important advantage of my invention resides in the configuration of the projections 73,74 which have vertical flat walls 76,77 facing each other and the centerline 72, and curvilinear sloping walls 78,79 facing outwardly. The projections 73,74 are not deep. As an example, in a nine-foot I have provided projections that protrude down about one and one quarter inches. These shallow projections, however, do add rigidity to the boat structure and confine water that enables the boat to plane at high speed. The fact that the walls 76,77 are vertical, rather than sloping, is believed to contribute significantly to the ability of the boat 10 to plane. I believe, furthermore, that a most important advantage of the projections 73,74 in their illustrated sectional configuration is manifested when the boat 10 is turned at high speed. When this occurs the projections prevent excessive skidding, and importantly, the fact that the outer walls are sloping prevents them from acting as fulcrums for tipping the boat over. Whenever a turn is made it is the projection on the inside of the turn radius whose flat edge brakes against the water and allows the path of the boat to curve, while the sloping edge of the other projection allows water to pass under it without tipping the boat over. The projections 73,74 extend for their full depths forward for a distance between $\frac{1}{3}$ and $\frac{1}{2}$ the length of the boat, and then taper into the boat bottom 12 to disappear at the point 81 (FIG. 1). The illustrated boat 10, as an example, has an overall length of nine feet, an overall beam of 56 inches and a distance between the walls 76,77 of $23\frac{1}{2}$ inches. To mount the motor 17 I have provided an upright column 82 integral with the shell of the member 11 where the stern of the boat terminates at the recess 14. By means of conventional clamps 83,84 the motor 17 is clamped to the column 82 where the arm 58 can be unobstructedly connected to the cables 53,54 through turnbuckles 86,87. A gasoline feed line 88 of the motor 17 is connected by means of a marine fitting 89 to the pipe 37 emerging from the seal 39 (FIG. 4).

In the operation of my boat, when persons step aboard there is a tendency for one side or the other of the boat to dip, but the flotation afforded by one or the other of the thickened portions 21,22 will prevent capsizing and it is not necessary for the boarding party to assume a crouching position, as is done with known craft of this general type. When a fixed angular position of the motor is required to set a course against wind or current there if enough resistance to involuntary turning of the motor in the boat hereinabove to free the helmsman from constant manual control of the wheel. This results from the fact that the loops 63,64 amplify the modest resistance to turning inherent in the steering mechanism, as has been explained. Turning of the boat 10 is accomplished by turning the steering wheel to turn the motor 17. When the forward momentum of the boat would tend to cause it to move over tha broadside of its port beam (when making a right turn, for example) the projection 73 will pass its leading edge 78 freely over the water, but the leading edge 77 of the projection 74, being vertical rather than sloping, will create a drag.

The foregoing description has been exemplary rather than definitive of my invention for which I desire an award of Letters Patent as defined in the appended claims.

I claim:

1. An improved stand up boat suitable for two persons, said boat having a stern wall for attaching an outboard motor, and a steering mechanism for pivoting said motor comprising:

a shallow draft hull, said hull including a molded lower shell including a bow and a stern, and an upper deck including a stern deck portion affixed to said hull;

floatation foam filling said hull between said stern deck and said lower shell, said hull including a stern indentation sized to receive an outboard motor, said stern foam portion including a pair of spirally disposed channels, said channels sized to receive steering flexible line, said channels including looped portions proceeding outwardly from the center line of the boat hull, whereby the sizing of said channel and the looped portion thereof provides a frictional restraint on said steering flexible line to hold said outboard motor in a selected position.

2. An improved boat as in claim 1, wherein:

said foam channel loops subtend an angle greater than 225°.

3. An improved boat hull as in claim 2, including:

said lower shell including a pair of raised flanges disposed from the bow to the stern along the bottom of the hull, each of said raised flanges including a first wall substantially perpendicular to the bottom of the boat hull and an angularly tapered portion proceeding away from the center line of the boat.

4. An improved boat hull as in claim 3, including: p1 said stern portion having raised deck portion surrounding the hull indentation of each side, said portion raised substantially above the deck portion of the boat on each side of the stern whereby passenger egress or ingress out of or into the boat will have sufficient stability to prevent capsizing because of additional buoyancy from the raised portions above the water line.

* * * * *